US005249369A

United States Patent [19]

Mallet

[11] Patent Number: 5,249,369

[45] Date of Patent: Oct. 5, 1993

[54] METHOD AND APPARATUS FOR DRYING THE INTERIOR SURFACES OF HOLLOW ARTICLES SUCH AS AIR REBREATHING OR RESUSCITATOR BAGS

[76] Inventor: Mark Mallet, 51 Shady Lane Crescent, Thornhill, Ontario, Canada, L3T 3W6

[21] Appl. No.: 836,962

[22] Filed: Feb. 19, 1992

[51] Int. Cl.[5] ..... F26B 7/00

[52] U.S. Cl. ..... 34/21; 34/104

[58] Field of Search ..... 34/104, 22, 23, 16, 34/18, 21

[56] References Cited

U.S. PATENT DOCUMENTS

| | | | |
|---|---|---|---|
| 1,488,433 | 3/1924 | Baird . | |
| 2,000,506 | 5/1935 | Bromfield | 34/24 |
| 2,148,885 | 2/1939 | Walter | 34/24 |
| 2,333,713 | 11/1943 | Eiben | 15/269 |
| 2,351,482 | 6/1944 | Campbell | 34/15 |
| 2,521,297 | 9/1950 | Littell | 223/73 |
| 2,669,788 | 2/1954 | Drum et al. | 34/223 |
| 3,577,650 | 5/1971 | Brahm | 34/151 |
| 3,726,020 | 4/1973 | Lee . | |
| 3,958,340 | 5/1976 | Meyers | 34/1 |
| 4,193,204 | 3/1980 | Nerod . | |
| 4,209,913 | 7/1980 | Wallin et al. | 34/21 |

FOREIGN PATENT DOCUMENTS

| | | | |
|---|---|---|---|
| 1056471 | 10/1953 | France . | |
| 233528 | 12/1968 | U.S.S.R. . | |
| 8058 | of 1899 | United Kingdom | 34/104 |
| 318435 | 9/1929 | United Kingdom . | |
| 635162 | 4/1950 | United Kingdom . | |
| 1328194 | 8/1973 | United Kingdom . | |
| 1396565 | 9/1973 | United Kingdom . | |
| 2183318A | 6/1987 | United Kingdom | 34/104 |

*Primary Examiner*—Henry A. Bennet
*Attorney, Agent, or Firm*—Weldon F. Green

[57] ABSTRACT

Method and apparatus for drying or purging droplets or films of liquid from the interior surfaces of hollow articles having an access passageway leading to a chamber, such as air rebreathing or resuscitator bags used in medical procedures that includes supporting the bag so as to dispose the access passageway lowermost and generating and directing a gaseous stream, preferably pressurized air, up through a portion of the passageway and releasing same for expansion into the chamber by means of an upstanding tubular formation terminating in a nozzle in the upper region thereof and withdrawing the expanded airstream downwardly through the remaining portion of the access passageway, whereby adhering liquid is impelled to coalesce to descend under gravity as well as taken up by entrainment and evaporation into the downwardly discharging airstream.

9 Claims, 4 Drawing Sheets

METHOD AND APPARATUS FOR DRYING THE INTERIOR SURFACES OF HOLLOW ARTICLES SUCH AS AIR REBREATHING OR RESUSCITATOR BAGS

FIELD OF THE INVENTION

This invention relates to improvements in the treatment of components used in surgical or patient care procedures in hospitals, surgical suites or in other circumstances so as to restore those components to an acceptable condition or standard that renders them fit for reuse.

More particularly this invention relates to improvements in a method and apparatus for drying the interior surfaces of hollow articles such as air rebreathing or resuscitator bags following the cleansing and sterilization steps in the process to ready them for reuse.

BACKGROUND OF THE INVENTION

When a patient submits to surgery under general anaesthesia and his respiration is to be monitored, or when a patient is to be revived by inducing respiration, the attending anaesthetist, physician, or other professional will insert a tube into the throat to hold the breathing passage or airway open.

This intubation process includes the attachment and use within the system of an air rebreathing bag unit or a resuscitator bag unit as the case may be, moulded or otherwise fabricated from a suitable rubber compound or its equivalent which is structured to expand and contract in response to the inhalation and expiration functions of the lungs whereby a patient's condition can be visually monitored or through manipulation induce respiration as may be required for example under deep anaesthesia or where otherwise a patient's vital signs so indicate.

Interior surfaces of air rebreathing bag units or resuscitator bag units in such a setting will collect moisture from the gas mixture exhaled from the lungs. Interior surfaces of such hollow components therefore must be thoroughly cleansed and sterilized with aqueous or other solutions and dried before any reuse.

The time interval required for cleansing and sterilizing such hollow components carried out in available equipment is relatively short.

It is currently normal practice to subject air rebreathing or resuscitator bag units as well as other similar hollow articles to a lengthy drying step in which such articles are placed within an enclosure and subjected to heated air for a period of several hours to evaporate adhering liquid droplets before removal for reuse.

This extended time interval is not only a controlling factor in determining how many air rebreathing bag units, for example, must be purchased in order to maintain a full surgical schedule for any hospital or similar facility, but the elevated temperature causes deterioration of the rubber or equivalent compounds from which those articles are moulded or fabricated.

OBJECTS OF THE INVENTION

The object of this invention therefore is to provide an improved method and apparatus for more effectively readying for reuse a hollow article such as an air rebreathing or resuscitator bag unit or the like by substantially reducing the time interval required for the purging or removal of liquid droplets or film from the interior of such a component as compared with known procedures and at the same time providing conditions that minimize the likelihood of any significant impairment or deterioration of the rubber compounds or equivalent substances from which such a component has been moulded or fabricated and so extend its useful life.

More particularly it is an object to increase the efficiency of the drying step by adopting an improved method that increases the rate of removal of liquid or aqueous solutions in droplets or as a film adhering to the inner surfaces of such hollow components after the cleansing and sterilization steps have been completed without subjecting them to substantially elevated temperatures.

It is also an important object to provide improved drying apparatus that will readily accommodate substantial numbers of such hollow components so as to enhance efficiency and further reduce the overall cost of maintaining a full surgical schedule at any hospital or similar facility.

It is also a very important object to provide apparatus for accomplishing the requisite drying of such hollow components of a simplified construction thereby promoting ease of operation and control as well as economic production and maintenance.

FEATURES OF THE INVENTION

The principal feature of this invention resides in orienting a hollow article that includes a chamber provided with a reduced or restricted access passageway which has been subjected to a cleansing or sterilization or other step that includes a liquid or aqueous component leaving adhering droplets or films so as to dispose such passageway lowermost, then directing a stream of suitable gas under sufficient pressure to flow upwardly through a portion of the passageway for delivery into the chamber and there releasing the gaseous stream for expansion and inflation of the chamber and impingement upon the inner surface thereof and then withdrawing the expanded gaseous stream downwardly through the remaining portion of the access passageway for discharge into the surrounding atmosphere.

More particularly this invention resides in orienting a nonporous hollow article or component such as an air rebreathing bag unit or resuscitator bag unit that includes a resilient deformable collapsible chamber provided with a reduced or restricted access passageway which has been subjected to a thorough cleansing and sterilization step using an aqueous to other solution of detergents and sterilants so as to dispose such access passageway lowermost, then directing a stream of air under sufficient pressure confined to flow upwardly through a portion of the access passageway for delivery into the resilient deformable chamber thereof and there released for expansion to inflate and thereby expose the inner surface for impingement of the airstream thereupon and withdrawing such expanded airstream downwardly through the remaining portion of the access passageway and discharging same into the surrounding atmosphere at a lower pressure whereby the liquid droplets or films adhering to the exposed inner surface is impelled to coalesce and descend under gravity downwardly through the access passageway therebelow as well as taken up by entrainment and by evaporation in the downwardly discharging expanded airstream.

Still more particularly a feature of this invention resides in providing an upstanding pipe or tube length which presents a suitable nozzle formation in the upper region thereof for confining and directing the controlled gaseous stream to flow upwardly through a segment of the access passageway of such hollow component and into the resilient deformable chamber thereof, the cross section of such pipe or tube length being selected so as to occupy only a minor portion of the access passageway and having a length sufficient to place the nozzle formation substantially within the surrounding chamber of the resilient hollow article with the nozzle formation so structured as to effectively expose the surrounding inner surface thereof for impingement of the expanded gaseous stream thereupon and the withdrawal of the moisture laden stream downwardly through the unobstructed major portion of the access passageway.

Still another feature of this invention resides in providing apparatus that includes an upstanding arrangement of a plurality of pipe or tube lengths sufficiently spaced apart so as to accommodate any requisite inflation or expansion of the resilient deformable chambers of the hollow components whereby substantially full exposure of the surrounding chamber inner surfaces to the impingement of the projected gaseous streams thereupon will be insured.

Another important feature of the invention resides in supporting the hollow article from within upon the upper end of the inserted pipe or tube length itself or an extension thereof in a manner such that sufficient clearance is maintained below the access passageway for the ready escape of the exhausting gaseous stream therefrom and whereby the supported hollow article is readily oriented to extend substantially vertically in position for the delivery of the gaseous stream into the surrounding resilient deformable chamber of such article.

These and other objects and features will become apparent having regard to the following description which is to be read in conjunction with the accompanying sheets of drawings in which:

DESCRIPTION OF THE INVENTION

Figure 1:
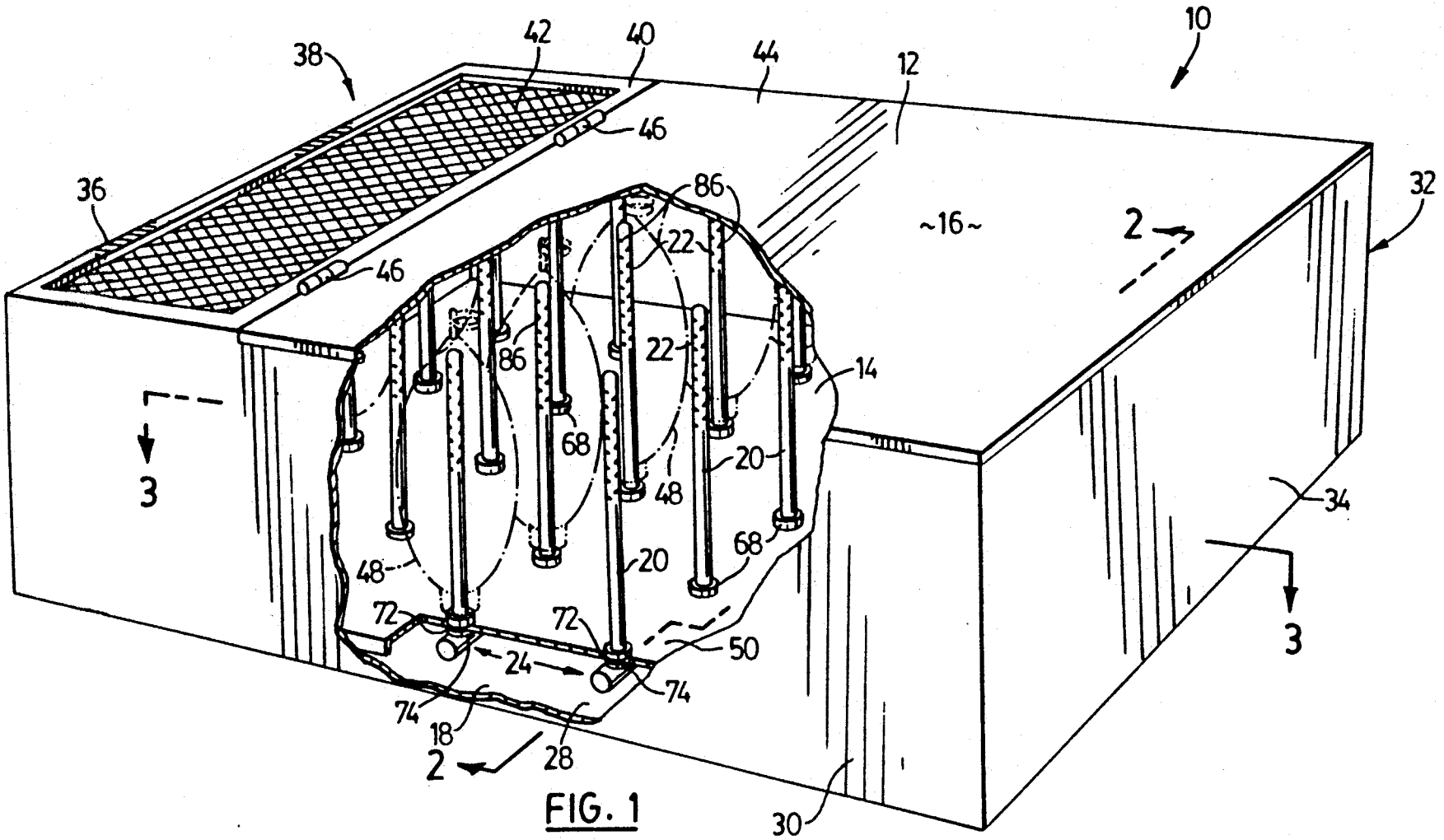
FIG. 1 is a perspective view partly broken away of a drying apparatus embodying the invention.

Apparatus 10 illustrated in perspective in FIG. 1 constitutes a preferred embodiment of the invention through which the steps of the improved drying method for cleansed and sterilized hollow articles such as typical air rebreathing bag units or the like can be implemented.

Apparatus 10 includes a repository or cabinet 12 divided into an upper compartment 14, accessible through a top opening generally indicated at 16, and a lower compartment 18 which is substantially enclosed.

The upper compartment 14 houses or confines a plurality of like suitable upstanding pipe or tube lengths 20 in substantially equidistantly spaced apart relation which present circumferentially disposed nozzle formations 22 in the upper regions thereof.

Lower compartment 18 houses or confines an integrated system or network of conduits or headers generally designated 24 which communicate with the upstanding tube lengths 20 for the delivery of air or other suitable gaseous medium under pressure to the nozzle formations 22 from a suitable fan or blower 26 shown mounted exteriorly of the repository or cabinet 12 at the rear.

Fan or blower 26 can also be mounted within lower compartment 18 or even located at a position remote from the enclosure as from a suitable source of pressurized air or gas if so desired.

The repository or cabinet 12 is fabricated from suitable sheet metal and reinforcing framework, preferably stainless steel, to promote a sterile environment and inhibit corrosion.

The structure of cabinet 12 includes a bottom panel formation or base 28, front and rear panels 30, 32, side panels 34, 36, a top vent structure 38 comprising a surrounding framework 40 fitted with a perforated metal sheet or screen 42 and top panel formation or closure 44 hinged as at 46 to one section of the framework 40.

Closure 44 swings upwardly about hinges 46 to provide ready access to the upper compartment 14 through top opening 16 for the introduction and registration and orientation of cleansed and sterilized elongated hollow air rebreathing or resuscitator bag units 48 illustrated in FIG. 4, upon the upstanding tube lengths 20 to be dried and for their later removal therefrom after that step has been completed.

An interior support formation or panel 50 likewise preferably derived from stainless steel, and mounted within repository or cabinet 12 uniformly spaced above the bottom wall panel or base 28 divides the interior into compartments 14 and 18 and constitutes the support for the integrated air delivery system or network 24 from below and the tube lengths 20 extending therebove.

The integrated air delivery system or network 24 includes a principal header 52 which extends within lower compartment 18 from the rear and opens through the rear panel 32 for connection to the output of the fan or blower 26 and terminates forwardly centrally of lower compartment 18 in a distributor fitting 54.

Distributor fitting 54 establishes communication between principal header 52 and opposed secondary headers 56, 58 of reduced cross section which extend generally longitudinally centrally of lower compartment 18 in opposite directions towards end panels 34, 36, respectively, and at right angles to principal header 52.

Each secondary header 56, 58 in turn is so joined to tertiary headers 60*a*, 60*b*, 60*c* and 60*d*, 60*e*, 60*f* of still further reduced cross section, respectively, to establish communication therebetween which tertiary headers extend generally at right angles thereto and generally transversely of lower compartment 18 front to rear and are arranged in substantially uniformly spaced apart parallel relation.

Figure 2:
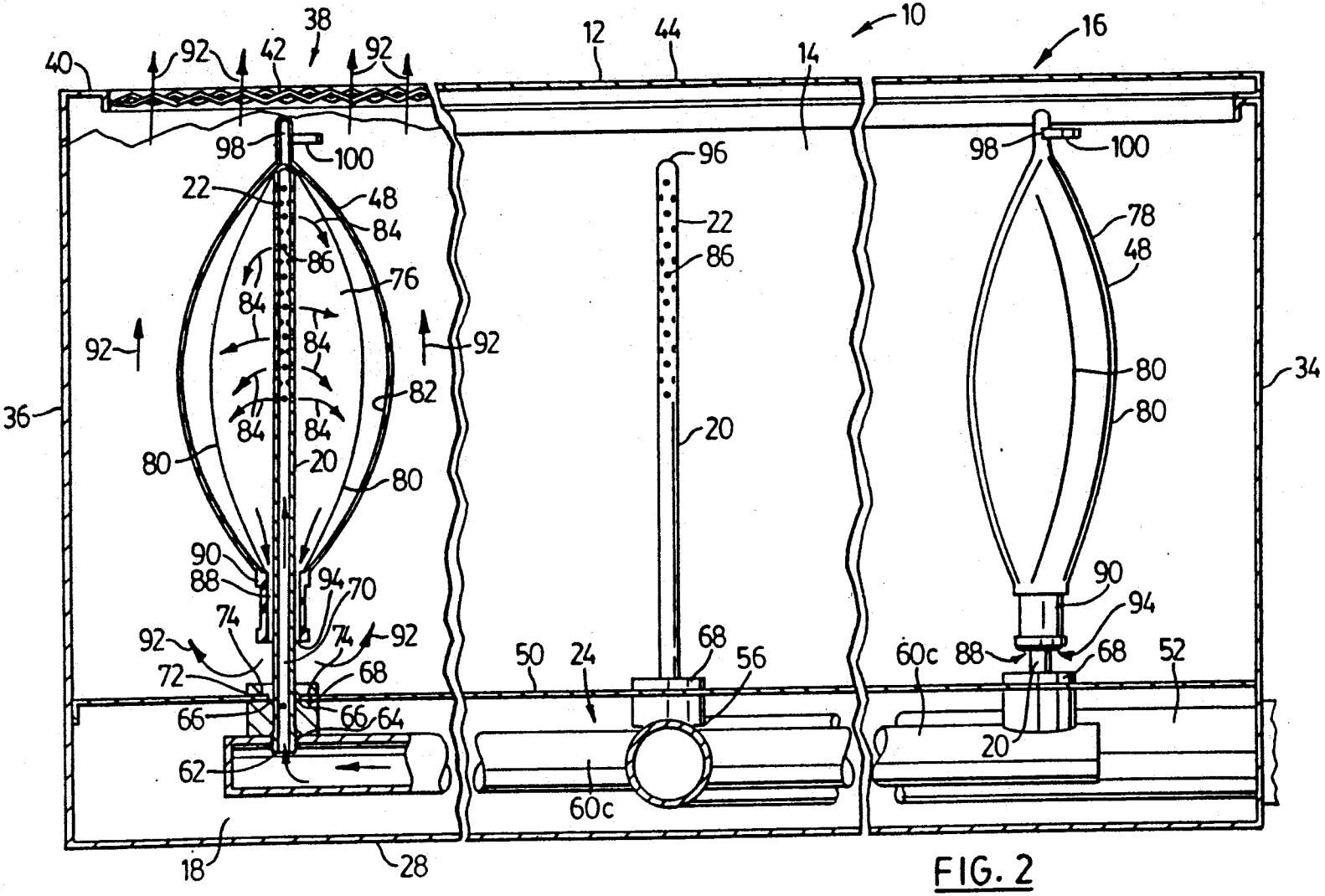
FIG. 2 is an elevational view in cross section and partly broken away of the drying apparatus illustrated in FIG. 1 taken along the lines 2—2 of FIG. 1 and fitted with hollow articles illustrating two different stages in the operation of the equipment.

Each of the secondary headers or conduits 56, 58 as well as the tertiary headers or conduits 60*a*, 60*b*, 60*c* and 60*d*, 60*e*, 60*f* are provided with tapped openings or fittings 62 for the connection with the threaded lower ends 64 of tube lengths 20 as illustrated particularly in FIG. 2 of the drawings.

The interior support formation or panel 50 as illustrated in FIG. 2 presents suitably dimensioned substantially uniformly spaced apart apertures 66 for the insertion and reception therewithin of contoured resilient mounting blocks 68 derived preferably from a suitable resilient stiff rubber compound or its equivalent, which mounting blocks 68 have an inner central aperture or bore 70 and an outer peripheral annular recess 72.

Each mounting block 68 is suitably dimensioned so that it can be manipulated and compressed for full registration and gripping engagement of the surrounding edge portion 74 of each aperture 66 of support formation or panel 50 within the annular recess 72, whereby central aperture or bore 70 of mounting block 68 will be disposed to extend substantially vertically for the reception and gripping engagement therewithin of the upstanding tubular length 20.

Other fasteners can be introduced to more securely anchor tubular lengths 20 to mounting blocks 68 or even directly to the support formation or panel 50 by means of, a yoke, not illustrated.

Also, if desired, metal mounting blocks preferably of stainless steel with threaded fittings could be substituted for the resilient mounting blocks 68.

Figure 3:
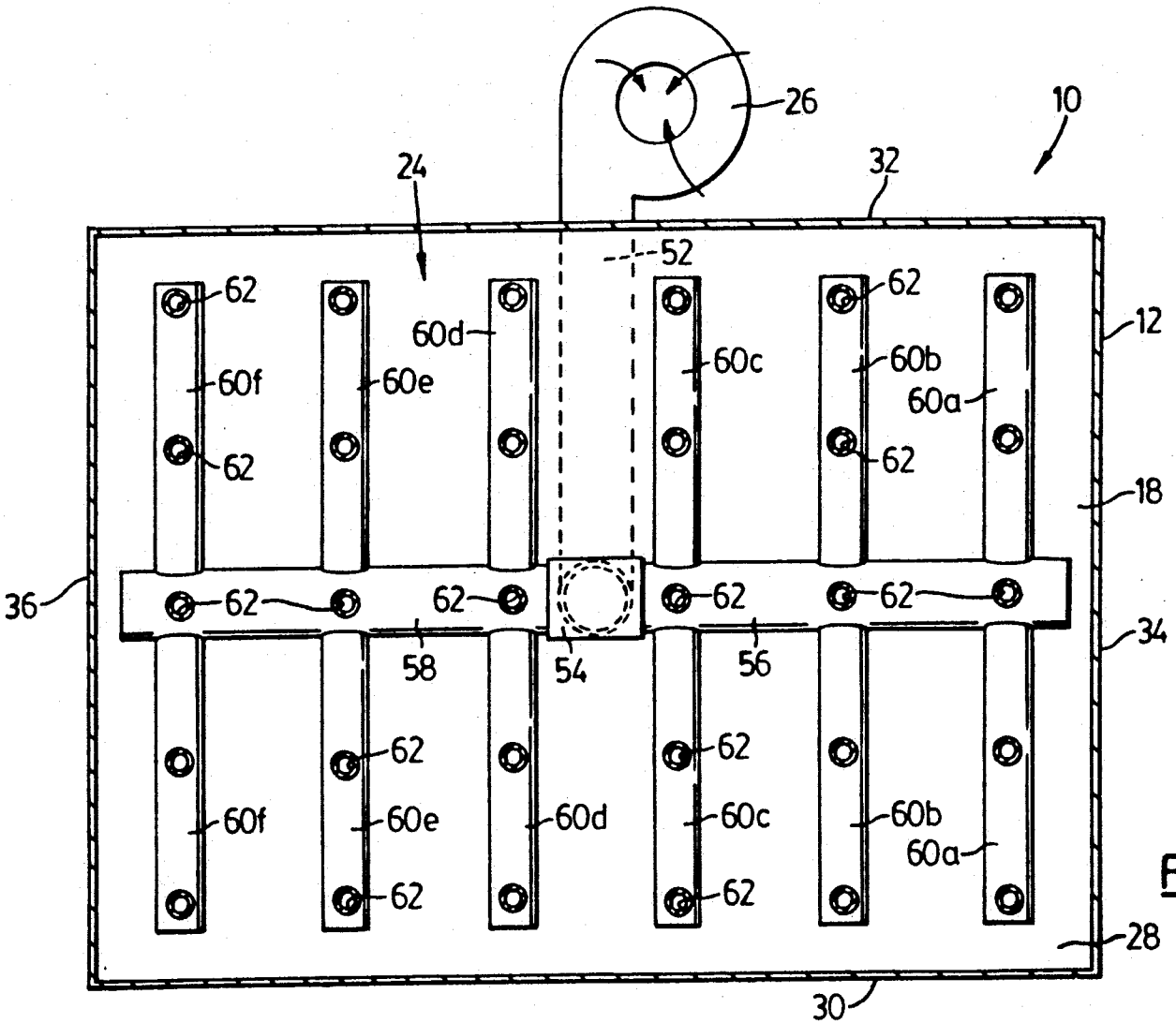
FIG. 3 is a plan view in cross section of the preferred drying apparatus of FIGS. 1 and 2 taken along the lines 3—3 of FIG. 1.

The spaced apart arrangement of the upstanding tube lengths 20 is apparent from FIG. 1 and their substantially equidistant placement revealed by FIG. 3.

It will be appreciated that in the preferred embodiment each secondary header 56 and 58 like tertiary headers 60*a*, 60*b*, 60*c* and 60*d*, 60*e*, 60*f* are also each likewise provided with openings 62 suitably tapped for the reception of the threaded lower ends 64 of the upstanding tubular lengths 20 whereby, as illustrated, an optimum number of drying stations for air rebreathing bag units 48 or similar units can be provided within the confines of upper compartment 14.

Figure 4:
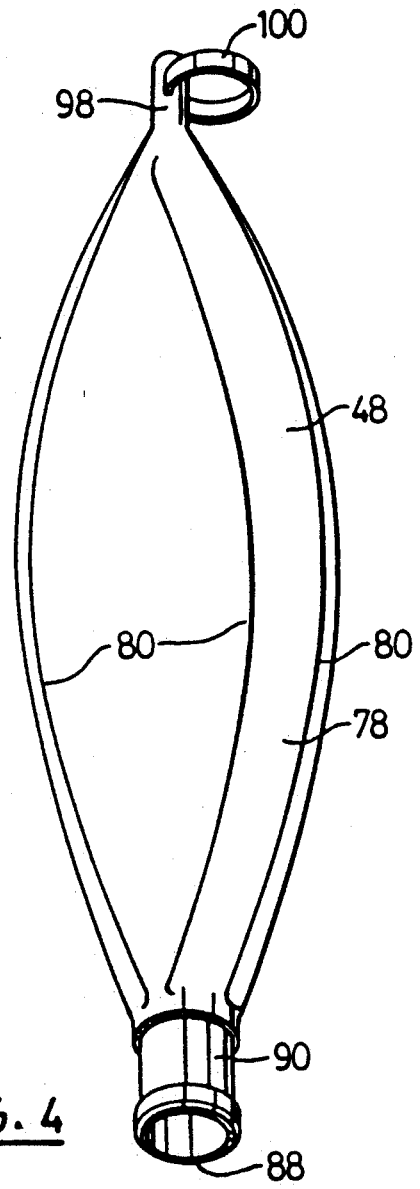
FIG. 4 is a perspective view of a typical air rebreathing bag unit with the deformable chamber shown in a collapsed disposition.

Particularly this spacing between the longitudinal upstanding axes of the tubular lengths 20 and from the surrounding panels enclosing upper compartment 14 will be selected so as to accommodate the dimensions of the hollow units to be dried and particularly the degree of expansion or ballooning to which they will be subjected as in the case of air rebreathing bags 48 or the like having nonporous resilient but thin walled chamber portions 76 which collapse in folds as indicated at 77 in FIGS. 2 and 4 without dislodging or blowing the units 48 off.

It is to be noted that in the preferred embodiment, air at normal temperature and pressure is intended to be supplied to the delivery system or network 24 by fan or blower 26 at a velocity sufficient to generate a slight positive pressure within the chamber portions 76 of the hollow units as compared with the pressure of the atmosphere within compartment 14.

The selected fan or blower 26 in the preferred embodiment delivers air to thirty such drying stations at a rate of the order of 290 cu. ft. per minute.

The pressure generated in the case of air rebreathing bag units 48 or the like must be just sufficient to unfold the collapsed wall 78 of the chamber portion 76 defined by folds 77 as revealed by FIG. 4 and FIG. 2 and expose the creases under slight inflation so as to present the surrounding inner surface 82 thereof to the direct impingement of the airstreams generally indicated by arrows 84 in FIG. 2 expanding through circumferentially placed perforations 86 of the nozzle formations 22.

The perforations 86 of nozzle formations 22 are preferably positioned substantially uniformly circumferentially and longitudinally along the designated upper portions of each tubular length 20 to the extent required.

It is also to be observed in the preferred embodiment that the cross sections of the tubular lengths 20 are selected having regard to the limited cross sections of the access passageways 88 within the thicker wall or neck portions 90 of hollow units 48 as compared with the thinner wall thicknesses of the chamber portions 76 so that the tubular lengths 20 penetrating the access passageways 88 occupy only a minor segment thereof leaving a major segment unobstructed for the channelling and downward discharge therethrough of the redirected gaseous streams indicated by the arrows 92.

Moreover, as will be observed from FIG. 2 the upstanding extent of the tube lengths 20 is determined having regard to the longitudinal dimensions of the hollow units 48 to be dried so as to provide sufficient clearance at the gap 94 at the lower end of neck portion 90 for the ready escape of the discharging gaseous streams 92 therefrom into the atmosphere of the surrounding upper compartment 14 and prevent dislodgement of the hollow units by blowing off.

It is also intended that the tubular lengths 20 be closed at their upper ends and suitably contoured as at 96 as in the case with air rebreathing bag unit 48, so as to readily register within the mouth 95 of a reduced tubular extension 98 thereof as revealed by FIG. 2.

The tubular extension 98 of unit 48 carries an external loop 100 for securing same to an upstanding tree or other support set up for that purpose in the operating theatre and could be used in further fixing the position of such unit 48 within compartment 16.

Other structures can be selected for mounting unit 48 upon tubular lengths 20 to provide adequate support in the uppermost or lowermost regions to establish proper orientation for a variety of hollow articles which have different configurations.

The preferred embodiment of the invention utilizing thirty stations for drying hollow articles such as bag units 48 which under slight positive pressure unfold and expand against the lesser pressure of the surrounding atmosphere of the compartment 14, provides for exhaust of the gaseous streams therefrom into compartment 14 and over the exterior surfaces of units 48, ultimately to escape from the top vent 38 into the outer atmosphere of the building.

The chambers of units 48 will upon unfolding and expansion each extend into the region surrounding upstanding tube lengths 20 in the manner depicted in cross section in FIG. 2 so that spacing selected must accommodate that distension.

More limited spacing can be chosen where expansion or inflation of unit 48 is relatively low so that a greater number of tube lengths can be accommodated within compartment 14 and the efficiency increased, with the air delivery system or network 24 and fan or blower 26 appropriately modified to achieve the desired results.

The capacity of the fan or blower 26 must be sufficient to deliver the requisite volume through the delivery system or network 24 over a selected range and of the order, in the case of the preferred embodiment, at approximately 290 cu. ft. per minute.

The circuit for energizing the motor for the fan or blower 26 will include well known appropriate controls for regulating fan or blower output.

Also a timing mechanism or other sensory instrumentation can be introduced to measure the moisture content of the discharged airstream for selectively establishing the proper interval for fan or blower 26 operation in carrying out the drying step.

Where any appreciable liquid draining downwardly from the interior of the hollow rebreathing bag units 48, and deposited upon the upper surface of support formation of panel 50 occurs, the coalesced liquid can be channelled to a discharge spout or to a centrally located drain by imparting an appropriate slope or contour thereto, alternatives which are not illustrated.

It is also contemplated that the gaseous medium to be delivered by the fan or blower can be sufficiently heated in appropriate circumstances by passing same through electrically energized resistance elements or other heat generating apparatus, not illustrated, mounted within the output of the fan or blower 26 or in principal header 52 and monitored and controlled by a suitable circuitry and timers, (not illustrated) for optimum results.

Any increment of heat generated would accelerate the evaporation of the liquid droplets or film adhering to both the inner and outer surfaces of hollow articles and the discharge into the surrounding atmosphere through the vent 38 as well as any liquid deposited upon the upper surface of the support formation 50.

It is also to be understood that where a limited number of hollow articles are to be dried an appropriate valve structure, not illustrated, could be installed within distributor 54 to direct flow to either secondary header 56 or 58 whereby either header could be isolated.

It is also contemplated that secondary headers 56 and 58 could also be provided with a valve structure, not illustrated, to selectively isolate the tertiary headers 60*a*, 60*b*, 60*c* and 60*d*, 60*e*, and 60*f*, respectively.

Thus can standard apparatus 10 be additionally equipped to serve the requirements of an operating theatre, by introducing regulatory instruments that may be required to ready a lesser number or a variety of nonporous hollow components for reuse in the circumstances outlined.

OPERATION

The improved method and apparatus preferably utilizes air at normal room temperature and pressure.

The hollow units 48 to be treated in accordance with the invention will be introduced into the inner compartment 14 through top opening 16 upon raising of closure 44 about hinges 46, with the access passageways 88 of neck portion 90 of units 48 disposed lowermost.

Each hollow unit 48 will be manipulated so as to present and lower same over an upstanding tubular length 20 with upper contoured end 96 thereof seated centrally within the mouth of the tubular extension 98 thereof.

So supported each hollow unit 48 is appropriately suspended or oriented to extend generally vertically downwardly with nozzle formation 22 located beyond access passageway 88 and within chamber portion 76.

The controls for apparatus 10 will have been calibrated so as to deliver preferably the requisite volume of air under pressure from fan or blower 26 through the air delivery system or network 24 to the designated upstanding tubular lengths 20 to expand through nozzle formations 22.

The pressure of streams 84 expanding through nozzle formations 22 to impinge upon the surrounding inner surfaces 82 of the chamber portions 76 without dislodging the units 48 so as to impart the necessary unfolding and inflation of the chamber portions 76 to expose the droplets of liquid and constrain them to coalesce and descend under gravity as well as to entrain droplets or evaporate them.

The coalesced droplets of liquid as well as the gaseous stream is channelled by the surrounding inner surfaces 82 to descend through the unobstructed portions of the access passageways 88 and discharge through the gaps 94 into surrounding compartment 14.

The gaseous streams 92 escaping from hollow units 48 circulate through the upper compartment 14 impinging upon the outer surfaces of the hollow units 48 and are ultimately expelled or discharged upwardly through vent 38 into the atmosphere.

This treatment will be continued over a requisite timed interval preferably of the order of 30 minutes that will ensure substantially complete removal of all droplets or films from the inner surfaces of such hollow articles 48 to a dryness standard established by the hospital authority or operating theatre and in a manner that minimizes any significant impairment or deterioration of the substances from which units 48 have been moulded or fabricated.

The dried units 48 can then be removed for storage and the next load introduced.

While the preferred embodiment of the invention has been illustrated and described variations or alterations may be undertaken by those persons skilled in the art without departing from the spirit and scope of the invention as defined by the appended claims.

What I claim is:

1. In a method for the removal of liquid adhering to the inner surface of a nonporous article that includes a normally collapsed chamber inflatable through a reduced passageway leading thereinto, the step of orienting the article so as to dispose the passageway lowermost, the step of generating a stream of suitable gas for introduction into the chamber through the passageway sufficiently pressurized so that upon release and expansion into the chamber the chamber will be inflated so as to expose the inner surface thereof for impingement of the expanded gaseous stream thereupon, the step of directing the generated gaseous stream upwardly through the passageway while confining same to one portion thereof and introducing same for release and expansion into the chamber to inflate same, and the step of withdrawing the expanded gaseous stream downwardly through the other portion of the passageway for discharge into a region at a lower pressure and at a rate which sufficiently maintains inflation of the chamber, whereby under inflation and exposure of the inner surface of the chamber to impingement of the expanded gaseous stream, the adhering liquid is impelled to coalesce and descend under gravity as well as taken up by entrainment and evaporation in the gaseous stream for discharge downwardly through the other portion of the passageway.

2. In apparatus for the removal of liquid adhering to the inner surface of a nonporous article which includes a normally collapsed chamber inflatable through a reduced passageway leading thereinto and having a longitudinal axis extending generally centrally of said passageway and said chamber, the combination of blower means having an inlet and outlet for generating a sufficiently pressurized stream of suitable gas from the outlet thereof, conduit means leading from said outlet including an upstanding portion terminating in nozzle means uppermost for conducting a generated gaseous stream from said outlet to said nozzle means for release therethrough into a region at lower pressure, said upstanding portion and nozzle means having a configuration in cross section for disposition within the passageway and chamber of said article respectively in loose fit when the article is oriented so as to dispose the passageway lowermost for registration thereover and having an overall extent sufficient to present said nozzle means within the chamber and above the passageway, said nozzle means including an upstanding elongated tubular portion in communication with said conduit means and presenting a pattern of a plurality of perforations throughout the substantial longitudinal extent of same and circumferentially spaced therearound for the release of the gaseous stream therefrom for expansion into the normally collapsed chamber at lower pressure and the inflation of same and impingement upon the surrounding inner surface of the chamber with the expanded gaseous stream descending downwardly through the passageway.

3. A method according to claim 1 wherein the introduced gaseous stream flows upwardly through a minor portion of said access passageway and the expanded gaseous stream is withdrawn downwardly through a major portion thereof.

4. A method according to claims 1 or 3 wherein said gaseous stream is derived from air at normal temperature and pressure.

5. Apparatus according to claim 2 wherein said upstanding portion and nozzle is provided with means for engaging the inner surface of the chamber of the article so as to support same thereupon from within.

6. Apparatus according to claim 5 wherein said engagement means includes a surface presented by the upper end of said upstanding portion and nozzle so contoured as to match the configuration of the inner surface of the chamber of the article in that region remote from the access passageway whereby the article is both uniformly oriented thereby to depend generally vertically and solely supported thereupon.

7. Apparatus according to claims 2, 5 or 6 wherein said conduit means terminates in a plurality of like upstanding portions each terminating in like nozzle means and are arranged in a selected spaced apart relation.

8. Apparatus according claims 2, 5 or 6 wherein an enclosure is provided for substantially isolating said upstanding portion and nozzle means during the interval of generation of the gaseous stream for substantially confining the expanded gaseous stream therewithin before releasing same into the surrounding atmosphere.

9. Apparatus according to claims 2, 5 or 6 wherein said gaseous stream generated is derived from air at normal temperature and pressure.

* * * * *